US005707046A

United States Patent [19]

Tillner

[11] Patent Number: 5,707,046

[45] Date of Patent: Jan. 13, 1998

[54] APPARATUS FOR FASTENING SINUSOIDAL SPRINGS OR THE LIKE TO THE FRAME OF UPHOLSTERED FURNITURE

[76] Inventor: Thomas Tillner, Am Amazonenwerk 44, 49205 Hasbergen, Germany

[21] Appl. No.: 595,948

[22] Filed: Feb. 6, 1996

[30] Foreign Application Priority Data

Dec. 1, 1995 [EP] European Pat. Off. ..... 95118906

[51] Int. Cl.[6] ..... F16F 3/02

[52] U.S. Cl. ..... 267/80; 5/259.1; 267/107; 267/106

[58] Field of Search ..... 267/80–112, 179, 267/144; 403/208; 5/259.1, 260, 261, 271, 255, 247, 282.1, 264.1, 194, 199, 274; 24/563, 546

[56] References Cited

U.S. PATENT DOCUMENTS

| | | | |
|---|---|---|---|
| 2,319,431 | 5/1943 | Owen | 5/260 |
| 2,542,458 | 2/1951 | Bank | 403/208 |
| 2,581,761 | 1/1952 | Haas | 267/144 |
| 2,657,738 | 11/1953 | Kruszone | 267/107 |
| 2,669,290 | 2/1954 | Neely | 5/260 |
| 2,695,658 | 11/1954 | Flint | 5/194 |
| 2,702,588 | 2/1955 | Zummach | 403/208 |
| 2,716,442 | 8/1955 | Larson et al. | 5/259.1 |
| 2,717,635 | 9/1955 | Stanton | 5/259.1 |
| 2,842,188 | 7/1958 | Hupp | 267/107 |
| 2,859,802 | 11/1958 | Asaro | 267/107 |
| 3,072,228 | 1/1963 | Neely | 403/208 |
| 3,551,282 | 12/1970 | Hogue | 5/259.1 |
| 3,992,853 | 11/1976 | Morris | 5/259.1 |
| 4,062,087 | 12/1977 | Lingle | 403/208 |
| 4,102,586 | 7/1978 | Pearson et al. | 5/259.1 |
| 4,973,032 | 11/1990 | Fourrey et al. | 267/144 |
| 5,505,436 | 4/1996 | Roick | 267/107 |

FOREIGN PATENT DOCUMENTS

| | | | |
|---|---|---|---|
| 1079684 | 6/1953 | France | 5/260 |

*Primary Examiner*—Douglas C. Butler
*Attorney, Agent, or Firm*—Jordan and Hamburg

[57] ABSTRACT

An apparatus for fastening the ends of sinusoidal springs or of similar flat spring elements to a part of a frame of upholstered furniture, includes a long, extended, one-piece plastic profiled strip with a fastening part, continuous over its length, for putting in place staples or similar fastening elements on the frame and in an accommodating part for the sinusoidal springs, which is to face the inner edge of the frame part, with clevis type eyelets for the spring ends, spaced apart in the longitudinal direction of the strip.

30 Claims, 2 Drawing Sheets

APPARATUS FOR FASTENING SINUSOIDAL SPRINGS OR THE LIKE TO THE FRAME OF UPHOLSTERED FURNITURE

BACKGROUND OF THE INVENTION

The invention relates to an apparatus for fixing the ends of sinusoidal springs or similar flat spring elements to a part of the frame of upholstered furniture.

Such frames of upholstered furniture consist predominantly of wood and individual clevis type eyelets are fastened to the frame for fastening the ends of the sinusoidal springs or the like. If these clevis type eyelets consist of metal, they are screwed to the frame; if they consist of plastic, they can also be fastened to the frame with the help of a staple gun. In any case, the fastening sites are limited here to the longitudinal dimension of the clevis type eyelet, so that the danger exists that, when the sinusoidal springs are subjected to high loads, the means, by which the clevis type eyelets are fastened to the frame, give way and the clevis type eyelet becomes detached from the frame. Moreover, fastening the individual clevis type eyelets to the frame is time consuming and labor intensive, since each clevis type eyelet must be handled individually for the fastening process.

SUMMARY OF THE INVENTION

It is an object of the invention to provide an apparatus for fastening the ends of sinusoidal springs or of similar flat spring elements to a part of the frame of upholstered furniture, by means of which apparatus the fastening of the clevis type eyelets to the frame is improved significantly and, as a result, their load-carrying capacity is increased. Furthermore, it shall be possible to carry out the fastening process itself in less time and with less effort.

Pursuant to the invention, this objective is accomplished by a long, extended, one-piece plastic profiled strip with a fastening part, continuous over its length, for putting in place staples or similar fastening elements in the frame and in an accommodating part for the sinusoidal springs, which is to face the inner edge of the frame part, with clevis type eyelets for the spring ends, spaced apart in the longitudinal direction of the strip.

For this embodiment, the fastening sites for the clevis type eyelets are no longer restricted to a region, specified by their axial length. Instead, due to the fact that the fastening part extends over the length of the plastic profiled strip, staples or similar fastening elements can be put in place not only in the respective region of the fastening part, adjoining the clevis type eyelet, but also in those regions of the latter between the clevis type eyelets at a more or less narrow distance from one another in the longitudinal direction of the fastening part, which distance has been adapted to the anticipated loads. In this way, the fastening sites can be increased to such an extent, that premature loosening of the fastening to the frame, when the upholstered furniture is in use, is practically excluded. Moreover, the inventive, plastic profiled strips can be fastened quickly and simply, since it is no longer necessary to handle each individual clevis type eyelet in order to fasten it. Instead, all clevis type eyelets, intended for the frame, can be fastened to the frame in a single step by the plastic profiled strip, the length of which corresponds to that of the frame.

All thermoplastic materials, which are suitable for the intended application and which make it possible, for example, to form the plastic profiled strip from a one-piece, injection-molded article, come into consideration as material for the plastic profiled strip. However, the plastic profiled strip can also be formed from a one-piece, extrusion molded article starting from a thermoplastic workpiece, from which clevis type eyelets have been punched out at specified distances. The punching equipment can advisably be formed here so that interchangeable tools can be used in order to be able to punch out pieces of different size from the accommodating part: By these means, the mutual distance between the clevis type eyelets in the longitudinal direction of the strip and, with that, their number can be varied over a specified length of the plastic profiled strip to correspond to the number of sinusoidal springs, which are to be fastened to the frame part. This number depends on the particular application.

The axial length of the clevis type eyelets, measured in the longitudinal direction of the strip, can also be changed in this manner or, irrespective of the mutual distance between eyelets, a constant length, which has been determined to be appropriate, can be retained for suspending and holding the ends of the springs.

Further distinguishing features and advantages of the invention arise out of the claims and the specification below in conjunction with the drawing, in which an example of the object of the invention is illustrated diagrammatically in the accompanying drawings.

DESCRIPTION OF THE PREFERRED EMBODIMENTS

Figure 1:
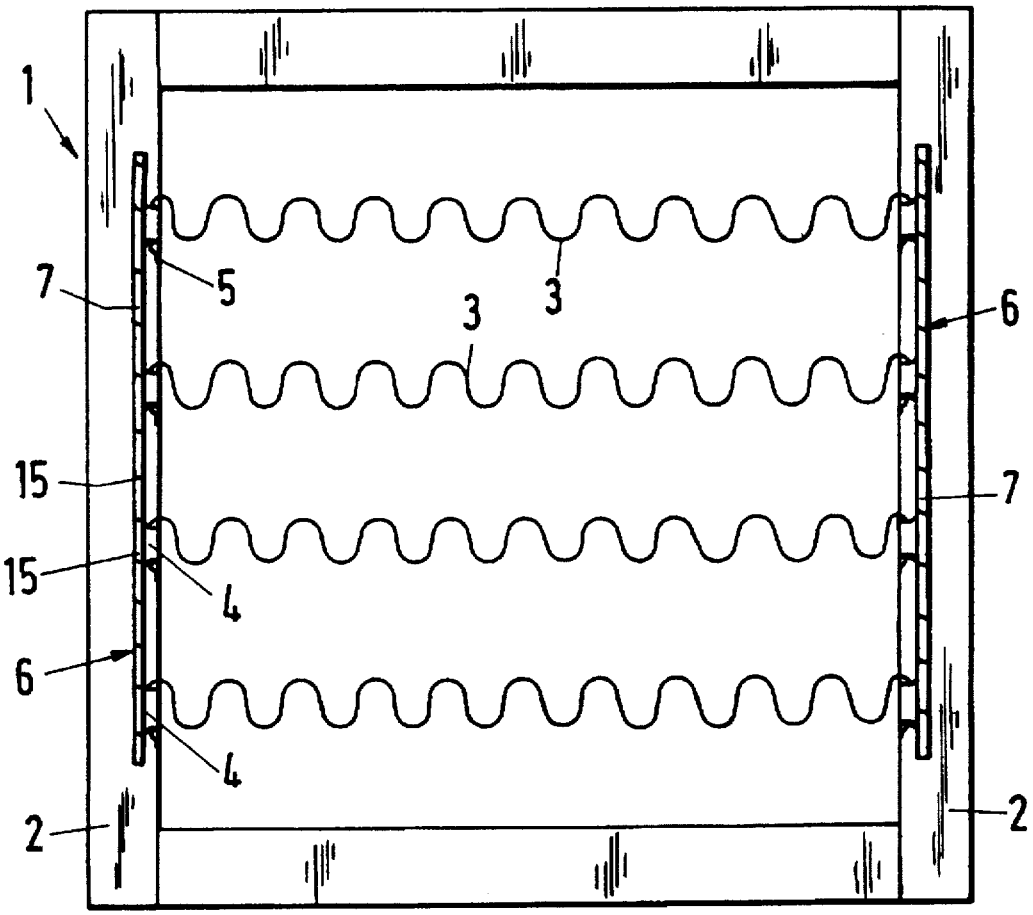
FIG. 1 shows a plan view of a frame of upholstered furniture with inventive plastic profiled strips fastened with a staple gun to two opposite parts of the frame and with sinusoidal springs suspended in the strips.

FIG. 1 shows a rectangular or square wooden frame, which is labeled 1 as a whole, of an upholstered item of furniture. Several sinusoidal springs 3 extend between two opposite parts 2 of the frame. In the case of the example shown, four sinusoidal springs 3 are provided and, correspondingly, four clevis type eyelets 4, for accommodating the respective ends 5 of the springs, are provided at each frame part 2.

Pursuant to the invention, the clevis type eyelets 4 are formed in each case at an elongated plastic profiled strip 6 in one piece with the latter. The plastic profiled strip 6 consists of a suitable thermoplastic material and comprises a fastening part 7 extending over its length and an accommodating part, which is to face the inner edge of the respective frame part 2 and is occupied by the clevis type eyelets 4. The distance between the clevis type eyelets corresponds to the specified distance between the sinusoidal springs 3.

The clevis type eyelets 4 are formed in each case by a short sleeve 8, which protrudes from the fastening part 7 of the plastic profiled strip 6 at right angles to its longitudinal extent towards the interior of the frame. In its longitudinal region 9, adjoining the inner edge of the frame part 2, the inner wall of the sleeve 8 is rounded off for the pivotable support of the respective end 5 of the spring.

In the upper region of its periphery, the sleeve 8 can be provided with an insertion slot for the end 5 of the spring.

Figure 2:
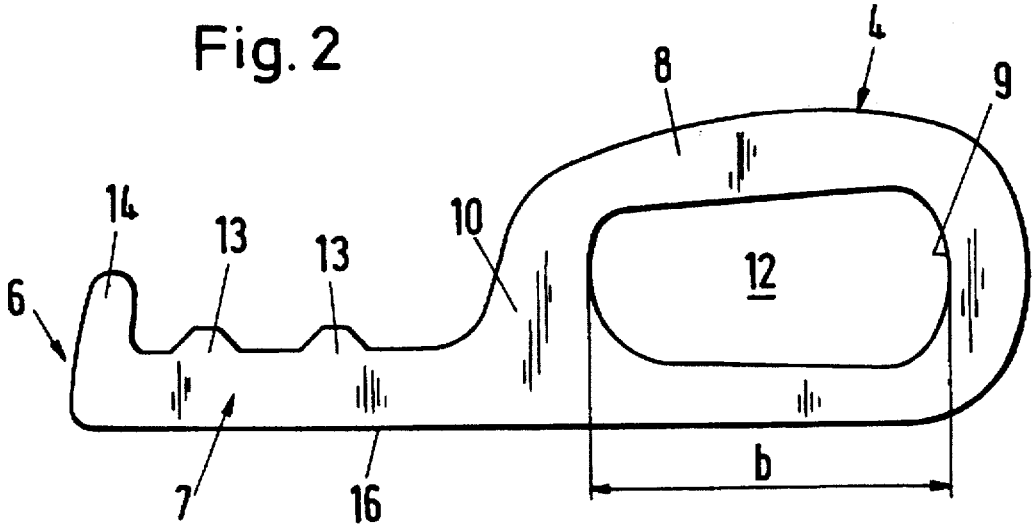
FIG. 2 shows a front view of an inventive plastic profiled strip on an enlarged scale.

Preferably, however, the sleeve 8 has a closed hollow profile at the periphery, as can be seen, particularly, in FIG. 2. At its-side opposite the wall region 9, the sleeve 8 changes over here into a thickened foot 10 and then into the fastening part 7. This development increases the load-carrying capacity of the sleeve 8.

The sleeve 8 is open at its two end faces 11 in order to make it easy to suspend the end 5 of the spring. Both end faces 11 are aligned at an angle to the longitudinal axis of the sleeve 8 and diverge towards the fastening part 7. As a result, each sleeve 8 has a broadened base, which goes over into the fastening part 7; in turn, this is suitable to increase the strength and the load-carrying capacity of the sleeves 8.

Figure 3:
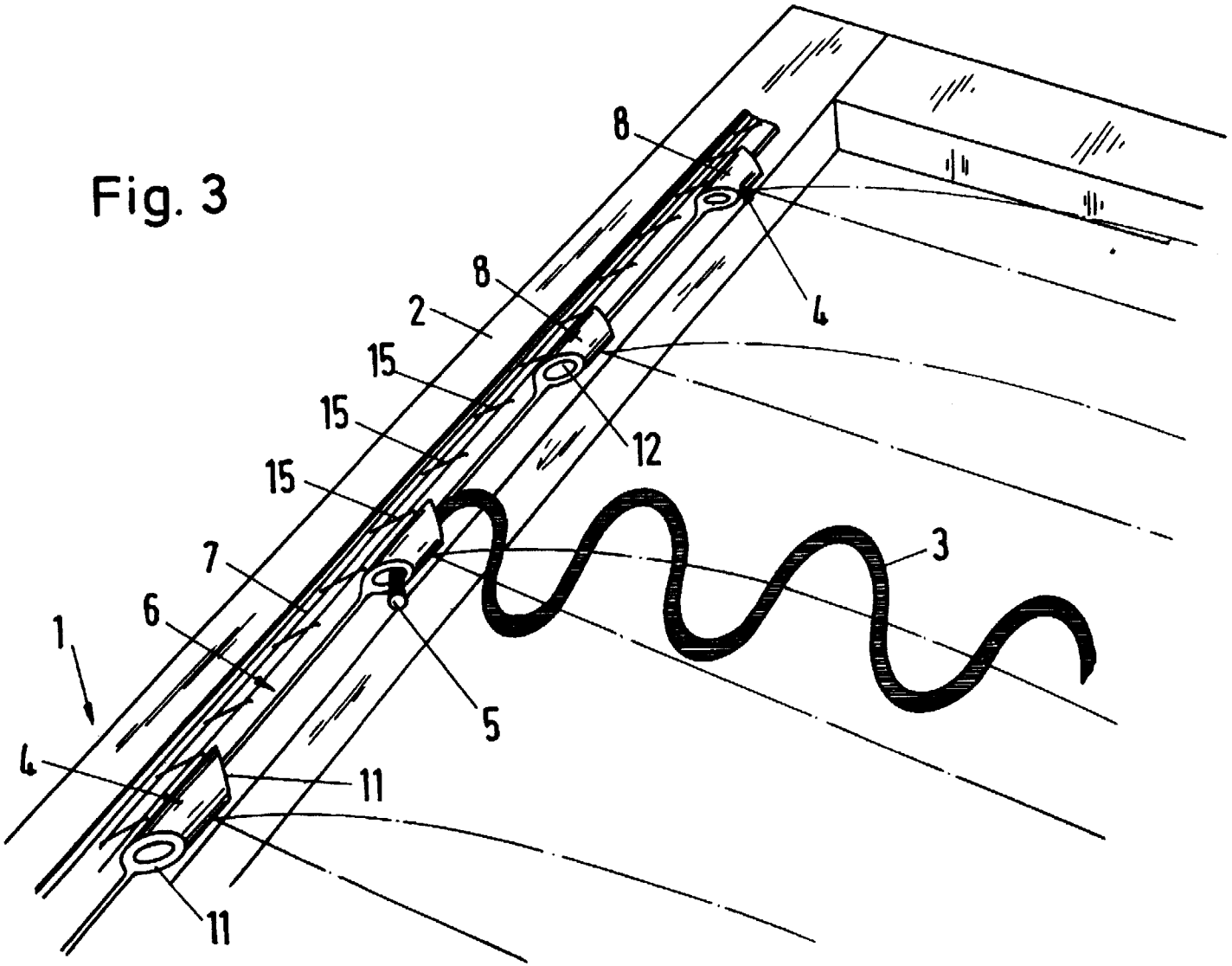
FIG. 3 shows a perspective representation of a corner region of the frame of FIG. 1 in a representation enlarged relative to that of FIG. 1.

The transverse internal dimension of the inner cavity 12 of the sleeve 8 is b, which is a multiple of, such as twice, the diameter of the sinusoidal spring 3. In this way, the end 5 of the spring can be introduced effortlessly through one of the end faces 11 into the cavity 12, so that a free end region of the end 5 of the spring protrudes in hook fashion from the other end face 11, as is shown particularly in FIG. 3. By these means, the end 5 of the spring is suspended securely in the cavity 12 and, at the same time, supported in this so that it is free to swivel, as is required by the loads exerted on the sinusoidal springs 3 when the upholstered furniture is in On the upper side, in its middle region, the fastening region 7 is reinforced by at least one reinforcing rib 13. For the example shown, two reinforcing ribs 13 are provided, which extend in the longitudinal direction of the fastening part 7 at a distance from one another. At its free longitudinal edge, the fastening part 7 is provided with a guiding rib 14, which protrudes above the upper side of the fastening part 7 as well as above its reinforcing ribs 13.

A tacker is passed along the inside of the guiding rib 14 for swiftly shooting staples 15 through the fastening part 7 into the frame part 2, in order to fasten the plastic profiled strip 6, which is placed down with its underside 16, as a whole to the frame part 2. As can be seen, for example, from FIG. 1, the staples 15 are shot into the fastening part 7 at an angle to the longitudinal edges of the latter so as to, at the same time, overlap the reinforcing ribs 13. The reinforcing ribs 13 here offer the staples 15 an increased mass for fixing the plastic profiled strip 4 securely to the frame part 2.

What I claim is:

1. A device adapted to fasten the end of springs to a frame of upholstered furniture comprising an elongated one-piece, plastic strip having an elongate axis extending in an elongate direction, said plastic strip having a fastening part adapted to receive fastening means for fastening the plastic strip to said frame, said plastic strip having a plurality of eyelets disposed to one side of said fastening part in a non-superinmposed position relative to said fastening part, said eyelets being spaced from one another along said elongate direction, said eyelets being adapted to receive the ends of said springs.

2. A device according to claim 1 wherein said fastening part is adapted to receive staples to provide for stapling said fastening part to said frame.

3. A device according to claim 1 wherein said eyelets are adapted to receive the ends of sinusoidal springs.

4. A device according to claim 1 wherein each of said eyelets is formed by a sleeve disposed to said one side of said fastening part in a non-super imposed position relative to said fastening part.

5. A device according to claim 4 wherein each of said sleeves has axis parallel to said elongate axis.

6. A device according to claim 4 wherein each of said sleeves has a support part against which the end of the spring is supported, said support part having an arcuate configuration to provide for pivoting of the spring ends in said sleeve.

7. A device according to claim 4 wherein said sleeve extends continuously 360 degrees to provide a closed sleeve.

8. A device according to claim 4 wherein said sleeve has two open longitudinal end faces.

9. A device according to claim 8 wherein each of said sleeves has a sleeve axis parallel to said elongate axis, said end faces being disposed at an acute angle relative to said sleeve axis.

10. A device according to claim 9 wherein each of said end faces diverge from one another as said end faces approach said fastening part.

11. A device according to claim 4 wherein said sleeves define an inner sleeve passage having a first dimension measured perpendicular to said elongate axis and a second dimension measured perpendicular to said first dimension, said first dimension being greater than said second dimension.

12. A device according to claim 4 wherein said sleeves define an inner sleeve passage having a width dimension measured perpendicular to said elongate axis, said width dimension being greater than the diameter of said spring.

13. A device according to claim 12 wherein said width dimension is at least twice the diameter of said spring.

14. A device according to claim 1 wherein said plastic strip has a lateral edge extending parallel to said elongate axis, said eyelets extending laterally from said lateral edge.

15. A device according to claim 14 wherein said lateral edge is designated a first lateral edge, said plastic strip having a second lateral edge spaced from and parallel to said first lateral edge, said plastic strip having an upper surface, and a reinforcing rib at said second lateral edge projecting above said upper surface.

16. A device according to claim 1 wherein said plastic strip has at least one reinforcing rib extending parallel to said elongate axis.

17. A device according to claim 1 wherein said plastic strip is adapted to be fastened by said fastening means along an inner edge of said frame.

18. A device according to claim 1 wherein said plastic strip including said fastening part and said eyelets are integrally formed from a single piece of material.

19. A device according to claim 1 wherein said plastic strip including said fastening part and said eyelets are integrally formed in one piece from an injection molded part.

20. A device according to claim 1 wherein said plastic strip is initially formed in one piece as an elongated extruded molded article having a constant cross sectional configuration along its length, and said eyelets being stamped at spaced intervals along the elongated extruded molded article to thereby provide spaced eyelets along the longitudinal length of said plastic strip.

21. A device according to claim 1 wherein said fastening part has at least one generally flat surface adapted to abut said frame, said eyelets each having at least one generally flat surface adapted to abut said frame, said generally flat surface of said eyelets forming a continuation of said generally flat surface of said fastening part.

22. A device according to claim 1 wherein said fastening part has at least one generally planar surface adapted to abut said frame, said eyelets each having at least one generally planar surface adapted to abut said frame, said generally planar surface of said eyelets being disposed in a common plane with said generally planar surface of said fastening part.

23. A device according to claim 1 wherein said elongate axis is a generally central elongate axis, said fastening part being disposed on one side of said generally central elongate axis, said eyelets being disposed on the opposite side of said generally central elongate axis.

24. A frame means for use in upholstered furniture, said frame means comprising a frame part, spaced elongated springs each having spring ends, an elongated one-piece plastic strip having an elongate axis extending in an elongate direction, said plastic strip having a fastening part, fastening means fastening said fastening part to said frame part, said fastening part having receiving means receiving said fastening means for fastening said plastic strip to said frame part, said plastic strip having a plurality of eyelets disposed to one side of said fastening part in a non-superimposed position relative to said fastening part, said eyelets being spaced from one another along said elongate direction, said spaced eyelets receiving the ends of said spaced springs.

25. A frame means according to claim 24 wherein said frame means includes a second frame part spaced from the first said frame part, and a second elongated one-piece plastic strip having a second elongate axis extending in a second elongate direction parallel to the first said elongate direction, said second plastic strip having a second fastening part, second fastening means fastening said second fastening part to said second frame part, said second fastening means having second receiving means receiving said second fastening part for fastening said second plastic strip to said second frame part, said second plastic strip having a plurality of second eyelets disposed to one side of said second fastening part in a non-super imposed position relative to said second fastening part, said eyelets being spaced from one another along said second elongate direction, said second spaced eyelets receiving the other ends of said spaced springs.

26. A device adopted to fasten the end of springs to a frame of upholstered furniture comprising an elongated, one piece plastic strip having an elongate axis extending in an elongate direction, said plastic strip having a fastening part having at least one generally flat surface, said fastening part being adopted to receive fastening means for fastening the plastic strip to said frame in which said generally flat surface of said fastening part abuts said frame, said plastic strip having a plurality of eyelets disposed to one side of said fastening part in a non-superimposed relationship with said fastening part, said plurality of eyelets being spaced from one another along said elongate direction, said eyelets being adopted to receive the ends of said springs.

27. A device according to claim 26 wherein said fastening part has a constant cross-sectional configuration perpendicular to said elongate axis, said constant cross-sectional configuration extending the length of said plastic strip.

28. A device according to claim 26 wherein said eyelets each have at least one generally flat surface adopted to abut said frame.

29. A device according to claim 28 wherein said generally flat surfaces of said eyelets form a continuation of said generally flat surface of said fastening part.

30. A device according to claim 28 wherein said eyelets have a spring-receiving portion for receiving the ends of said springs, said spring receiving portion being disposed in superimposed relationship with said generally flat surface of said eyelets.

* * * * *